United States Patent [19]

Cloutier

[11] Patent Number: 4,765,073

[45] Date of Patent: Aug. 23, 1988

[54] SNOW BLOWER WITH VERTICAL ENDLESS BELT DIGGER

[76] Inventor: Richard Cloutier, 23 Langevin, Boisbriand, Quebec, Canada, J7E 4H5

[21] Appl. No.: 88,646

[22] Filed: Aug. 24, 1987

Related U.S. Application Data

[62] Division of Ser. No. 864,877, May 20, 1986, Pat. No. 4,680,881.

[51] Int. Cl.[4] ..... E01H 5/04

[52] U.S. Cl. ..... 37/237; 37/232; 37/244

[58] Field of Search ..... 37/237, 238, 239, 240, 37/232–233, 225, 208, 244, 192 R, 192 A, 253; 198/509, 698, 699, 699.1, 793, 822, 831, 844, 845; 414/527, 528

[56] References Cited

U.S. PATENT DOCUMENTS

| | | | |
|---|---|---|---|
| 244,784 | 7/1881 | Ayres | 37/208 |
| 344,405 | 6/1886 | Rollins | 37/208 |
| 542,209 | 7/1895 | Siccardi | 37/237 |
| 641,804 | 1/1900 | Shirreffs | 37/225 |
| 720,942 | 2/1903 | Manlon | 37/208 |
| 1,016,411 | 2/1912 | Isaacs | 37/237 |
| 1,017,092 | 2/1912 | Gardner | 37/237 |
| 1,077,918 | 11/1913 | Seck | 198/822 |
| 1,535,699 | 4/1925 | Talbot | 37/237 |
| 1,590,884 | 6/1926 | Bryant | 198/699 |
| 1,746,417 | 2/1930 | Chrul | 37/239 |
| 1,770,545 | 7/1930 | Nelson | 37/237 |
| 2,557,515 | 6/1951 | Riker | 198/699 |
| 2,736,112 | 2/1956 | Boissonault | 37/238 |
| 2,743,829 | 5/1956 | Ballard | 414/528 |
| 2,809,743 | 10/1957 | Hinchciffe | 198/699 |
| 3,081,565 | 3/1963 | Varnum | 37/238 |
| 3,308,563 | 3/1967 | Danek | 37/238 |
| 3,318,028 | 5/1967 | Wandscheer | 37/235 |
| 4,053,183 | 10/1977 | Probst | 37/232 |
| 4,697,693 | 10/1987 | Rajala et al. | 198/698 X |

FOREIGN PATENT DOCUMENTS

| | | | |
|---|---|---|---|
| 44044 | 12/1960 | Poland | 198/699 |
| 565502 | 8/1975 | Switzerland | 414/528 |

*Primary Examiner*—Eugene H. Eickholt

*Attorney, Agent, or Firm*—Foley & Lardner, Schwartz, Jeffery, Schwaab, Mack, Blumenthal & Evans

[57] ABSTRACT

A snowblower is disclosed wherein use is made of one vertically disposed endless snow conveying belt to which are secured transverse snow scraper members. The forward strand of the belt is made to travel downward, the scraper members digging into the snow to drive it at the rear of the belt where the scraper members of the upwardly moving rearward strand drive the snow through a conventional outlet arrangement including an elongated opening extending the full width of the casing top wall. The snowblower may make use of a single endless snow conveying belt with scrapers cooperating with the back wall of the casing or else use is made of two snow conveying belts, with appropriate snow scrapers, travelling in opposite directions and forming a snow discharge channel between them wherein the snow is powerfully driven upward through the top wall opening having an appropriate chute for guiding the snow being discharged.

9 Claims, 5 Drawing Sheets

Fig. 7
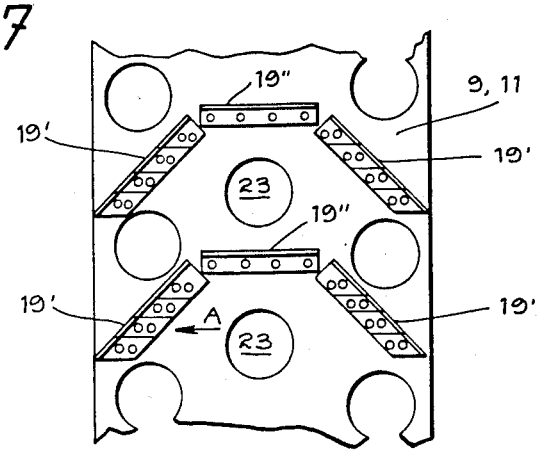
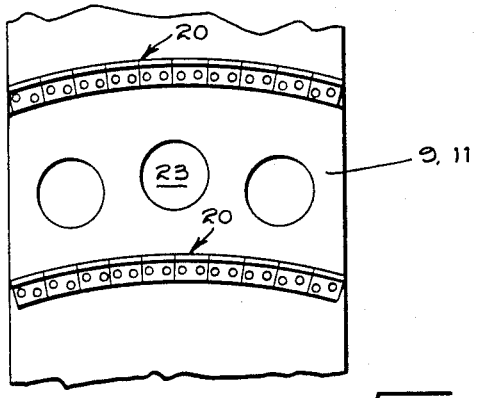
Fig. 8
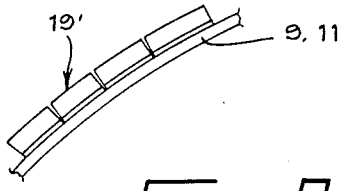
Fig. 9

SNOW BLOWER WITH VERTICAL ENDLESS BELT DIGGER

CROSS REFERENCE

This application is a division of application Ser. No. 864,877 filed on May 20, 1986, now U.S. Pat. No. 4,680,881 issued July 21, 1987.

BACKGROUND OF THE INVENTION

1. Field of the Invention

The present invention relates to a snowblower, more particularly a motorized snowblower of the domestic type handled by a walking attendant.

2. Description of the Prior Art

There are of course a multitude of snowblowers of the above type presently known and on the market. Most of them make use of a powered screw wherein the helical ridge displaces the snow toward a blower, located at one end of the blower casing, which in turn drives the snow upwardly into an orientable discharge chute. In some cases, the blower is located at the center of the casing and two screws are provided one on each side of the blower; the working principle being however the same.

It is found that, oftentimes, the screw or screws get jammed, at least partially, in the casing on account of snow rapidly packing up between the helical ridges. The packing of the snow is believed to be due to the restricted area available for the discharge of the snow through the necessarily limited size of the blower, as compared to the snow receiving area of the screw or screws. The result is that the casing tends to be lifted up the ground thereby providing an inefficient snow removal.

SUMMARY OF THE INVENTION

The present invention is an improvement, of the above-defined snow blowers, through the application of an entirely different concept of snowblowing, which concept involves the use of at least one vertically disposed endless snow conveying belt to which are secured transverse snow scraper members. The forward strand of the belt is made to travel downwardly, the scraper members digging into the snow to drive it at the rear of the belt where the scraper members of the upwardly moving rearward strand drive the snow through a conventional outlet means that, however, advantageously can include an elongated opening extending the full width of the casing top wall. The fact that the snow is picked up on the full transverse width of the casing and is eventually driven out through the aforesaid top wall elongated opening, also through the full transverse width of the casing, appreciably decreases the tendency of the snowblower to clog.

More specifically and in accordance with one version of the invention, there is provided a snowblower comprising: a casing having a generally rectangular opening; a front and a rear endless travelling belt and means mounting the belts vertically and in parallel relationship one behind the other, on and within the casing; each belt defining a forward strand and a rearward strand with respect to the opening; the belts being spaced apart and defining a vertical channel therebetween, the rearward strand of the front belt facing the forward strand of the rear belt in the vertical channel; snow scraper members fixed to and projecting perpendicularly away from the belts, transversely thereof; means driving the belts into endless travel at equal speeds and in reverse directions with respect to one another and with the forward strand of the front belt moving downwardly, and wherein the snow scraper members are spaced at predetermined intervals, from one another, the intervals being selected so that the snow scraper members of one belt are aligned in pairs with the snow scraper members of the other belt when moving along the channels According to a further version, the invention is a snowblower comprising: a casing having an upstanding rear wall and a generally rectangular opening facing the rear wall; an endless belt and means mounting the belt vertically on and within the casing between the rear wall and the opening, the belt defining a forward strand facing the opening and a rearward strand facing the rear wall at a distance therefrom; snow scraper members fixed to and projecting away from the belt, transversely thereof; means driving the belt in endless travel with the forward strand moving downwardly; and wherein the snow scraper members have a projecting length, away from belt, essentially equal to the distance between the rearward strand and the rear wall.

A prior art search has been made which has disclosed the following four U.S. patents:

1,848,554 of 1932
3,359,661 of 1967
4,294,027 of 1981
4,346,526 of 1982

None of the aforesaid patents discloses or suggests the use of one or two endless snow conveying belts provided with snow scraper members.

A description of embodiments of the invention now follows having reference to the appended drawings.

BRIEF DESCRIPTION OF THE DRAWINGS

FIG. 5 is a side elevation view of the snowblower of FIG. 1;

FIGS. 7 and 8 are front views of a portion of two belts each having different types of transversely disposed scraper members;

FIG. 9 is a view of a group of scraper members taken along arrow A of FIG. 7;

DESCRIPTION OF PREFERRED EMBODIMENTS

Figure 1:
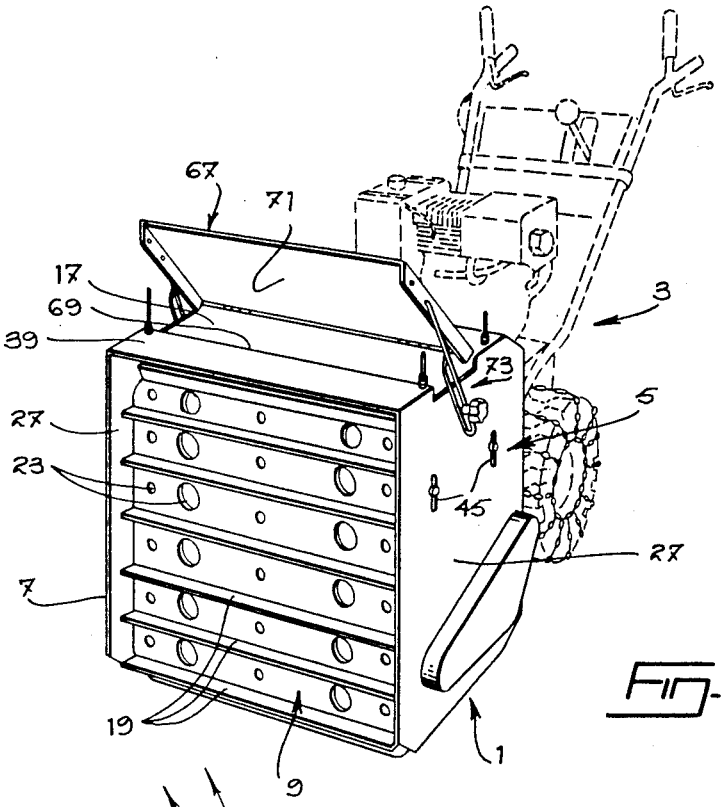
FIG. 1 is a perspective view of a first version of a snowblower according to the present invention.
Figure 2:
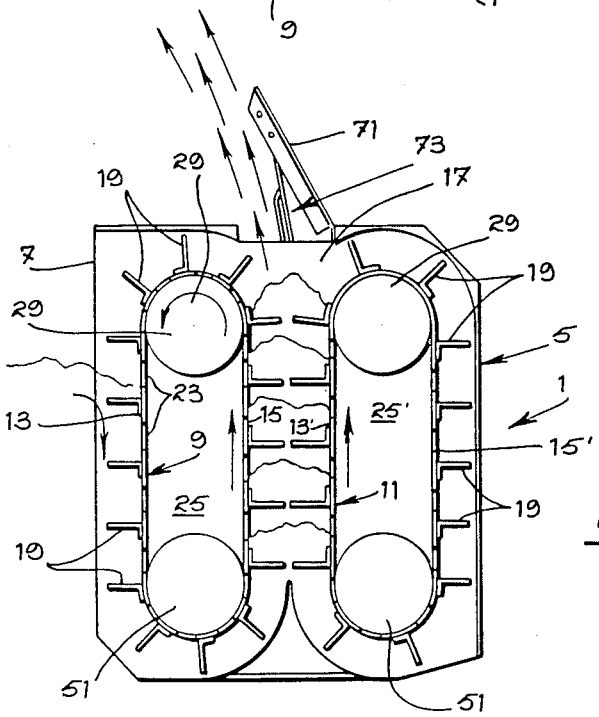
FIG. 2 is a longitudinal cross-sectional view of the snowblower of FIG. 1.

With particular references to FIGS. 1 and 2, there is shown a snowblower 1, made according to the invention, mounted on a conventional traction and power equipment 3 (see also FIG. 5) for actuation by a walking attendant. As said, this equipment 3 is conventional and therefore does not form part of the invention.

The snowblower 1 has a casing 5 which is a parallelepiped body having a front opening 7 of generally rectangular shape. A front endless travelling belt 9 and a rear endless travelling belt 11 are mounted vertically and in parallel relationship one behind the other on and within the casing 1, as will be further detailed later. The front belt 9 defines a forward strand 13 and a rearward strand 15. Similarly, the rear belt 11 defines a forward strand 13', facing the rearward strand 15 of the front belt 9, and a rearward strand 15'. The belts 9, 11, are spaced apart so that the strands 15 and 13' define therebetween a vertical channel 17.

Snow scraper members 19 are secured to and project perpendicularly away from the belts 9, 11, transversely thereof as best shown in FIG. 1. Means, to be more fully described later, drive the belts 9, 11, into endless travel at equal speed and in reverse directions with respect to one another and with the forward strand 13 of the front belt 9 moving downwardly. The movements are shown by the arrows in FIG. 2

The snow scraper members 19 are spaced at predetermined intervals, advantageously equal intervals, from one another. The intervals are selected so that the snow-scraper members 19 of one belt are aligned in pairs with the snow scraper members of the other belt when the scraper members move upward into the channel 17, as clearly illustrated in FIG. 2.

Figure 11:
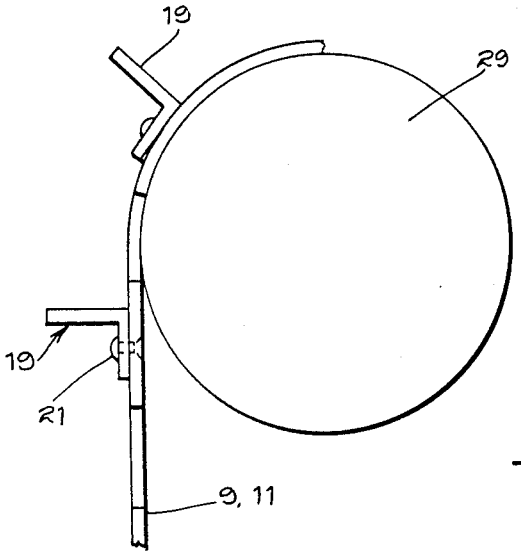
FIG. 11 is a diagrammatic side elevation view of a portion of an endless belt with snow scrapers winding around a guiding roller.

The scraper members of the embodiment of FIGS. 1 and 2 are angular members (see also FIG. 11) having one flange projecting perpendicularly from the belts 9, 11, while the other flange is parallel to the belt and is secured to it by means of rivets 21 such as shown in FIG. 11. Preferably and as mentioned above, the scraper members 19 are evenly spaced from one another.

As to the belts 9, 11, they can be made of rubbery material such as that used for the treads of snowmobiles. As to the scraper members 19, they can be made of metal.

It will be noted, particularly from FIG. 1, that the belts are formed with apertures 23, between the scraper members 19, for the ejection, into the channel 17, of snow that may have filtered into the spaces 25, 25' between the strands of the belts 9, 11. This snow may have entered into spaces 25, 25', by moving between the extreme ends of the belts 9, 11, and the sidewalls 27 of the casing 5.

The means that mount each of the belts 9, 11, on the casing are as follows, reference being had to FIGS. 2, 3, 5 and 10. Such means comprise, for each belt, three upper rollers 29 and a shaft 31 of which the ends are secured to blocks 33 vertically displaceable in slides 35 fixed to the sidewalls 27 of the casing 5, as shown in FIG. 5. Upwardly projecting from each block 33 (see FIG. 3) is a rod 37 having a threaded end extending through the top wall 39 of the casing 5, this threaded end being provided with a pair of nuts 41. As will readily be understood, vertical adjustment of the blocks 33 may thus be obtained by screwing the lower nuts and once proper tightening of the belt is obtained, the upper nuts 41 are screwed down for locking purposes. The end of the shaft itself is preferably provided with a locking screw 43 displaceable in vertical slots 45 through the sidewalls 27, as shown in FIG. 1.

As to the upper rollers 29 themselves, they are freely rotatable on the shaft 31 through the use of a roller bearing, for instance. It should also be appreciated that the number of rollers 29 may be smaller or larger depending upon the transverse width of the belts 9, 11.

There has thus been provided the required means for mounting the belts at their upper ends thereof and once proper tightening of the belt is obtained, the adjustment may be secured by tightening the locking screws 43 against the sidewalls 27.

Figure 3:
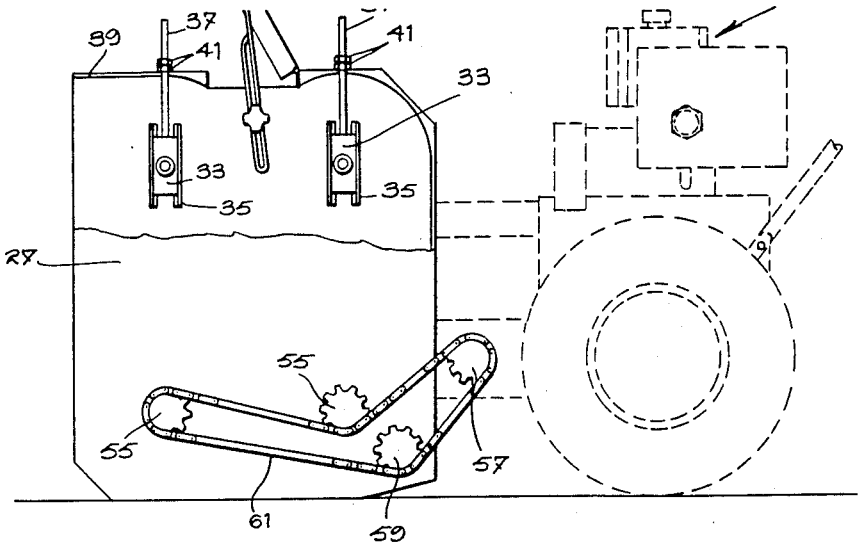
FIG. 3 is a side elevation view, with part thereof in cross-section, of a portion of the upper end of the belt guiding roller mechanism, the belt itself not being shown.
Figure 4:
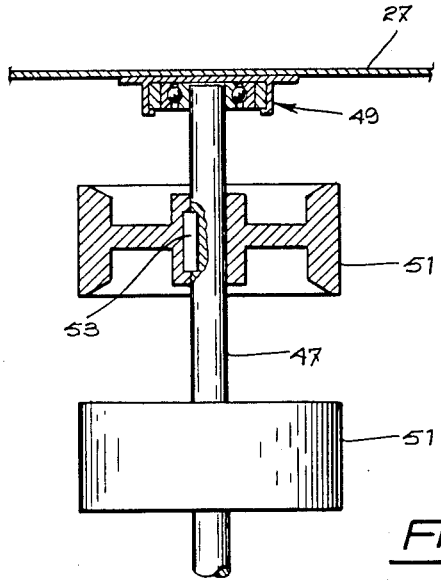
FIG. 4 is a view similar to that of FIG. 3 but showing the lower end of the belt guiding roller mechanism.

FIG. 4 illustrates a similar arrangement for the rotary mounting of the belts 9, 11, the latter being omitted for clarity. In that case, the belt tightening means 33, 35, 37 and 41 of FIGS. 3 and 5 are not needed and, consequently, the shafts corresponding to each belt 9, 11, need only have their ends mounted for rotation on ball bearing assemblies 49 of the casing sidewalls 27. The shafts 47 are, however, the driving shafts so that the lower rollers 51 have to be driven by the shafts and this may be obtained in any conventional manner such as having the rollers 51 fixed thereto by means of splines 53.

Figure 10:
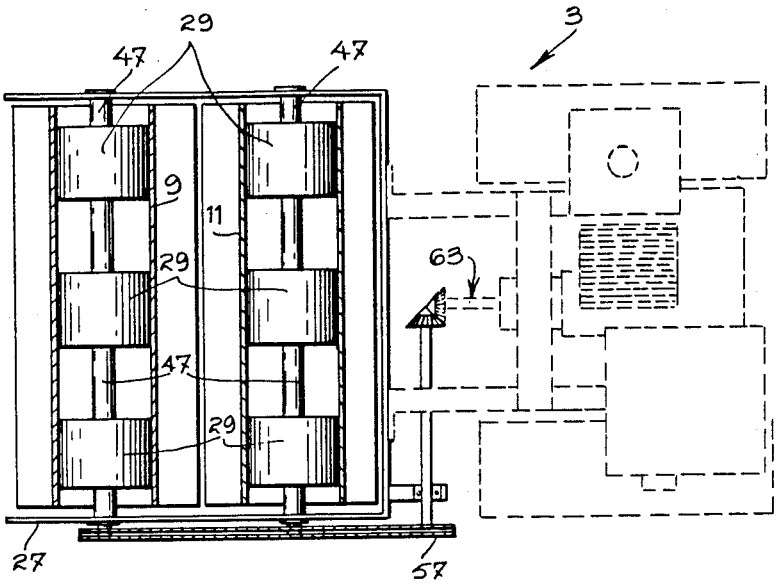
FIG. 10 is a top plan view of the snow blower of FIG. 1.

As best illustrated in FIGS. 5 and 10, one end of each lower driving shaft 47 extends out of one sidewall 27 and is provided, at that end, with a driven sprocket wheel 55. The power means for the shafts 47 also comprise a driving sprocket wheel 57, an idler sprocket wheel 59 mounted for free rotation on the sidewall 27 and a sprocket chain 61 suitably winding around the two driven sprocket wheels 55 to cause rotation of the two shafts 47 in reverse direction, as aforesaid. FIG. 10 shows that the driving sprocket wheel 57 may derive its power from a power take off 63 of the traction and power equipment 3.

Referring to FIG. 7, it will be seen that the scraper members may each comprise two downwardly inclined end scraper parts 19' and a central horizontal scraper part 19" therebetween. The downwardly inclined and scraper parts 19' may themselves be made up of a series of short sections so as to adequately bend when the belts 9, 11, wind around the rollers 29, 51.

Another possible arrangement is that illustrated in FIG. 8 where the scraper members 20 are made up of a series of short sections, similar to those of the end parts 19' of FIG. 7 but being disposed in a slightly bent configuration transversely of the belt.

Figure 6:
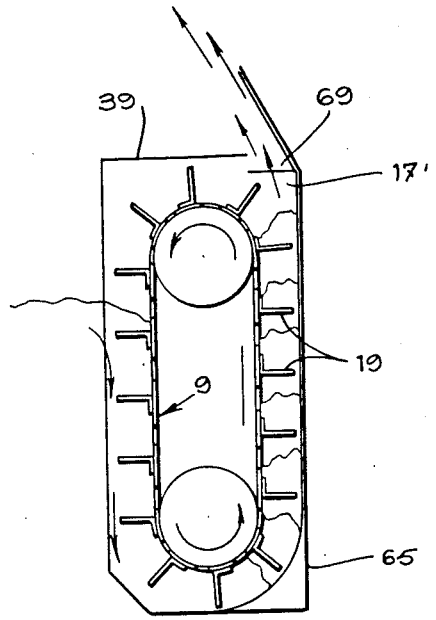
FIG. 6 appearing on the same sheet of drawing as FIG. 3, is a transverse cross-sectional view, similar to that shown in FIG. 2, but of another version of the snowblower according to the invention.
Figure 3:
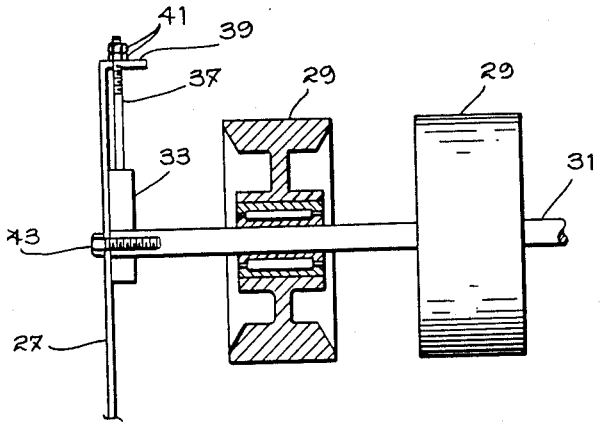

In the embodiment illustrated in FIG. 6, only one endless travelling belt 9 is used, its rearward strand facing the back wall 65 of the casing 5 at a distance therefrom suitable merely to allow passage of the successive scraper members 19, this rearward strand and the back wall 65 defining therebetween a vertical snow ejection passage 17', similar to channel 17 of FIG. 2. The means for guiding and driving the front belt 9 are of course the same as those described in relation to the embodiment of FIG. 2.

In both snowblowers of FIGS. 1 and 6, the top wall 39 is provided with snow outlet means 67 provided directly above the channel 17, 17' for the discharge of snow blown by the travelling belts 9, 11, and the scraper members 19. This outlet means 67 comprise an elongated opening 69 extending the full width of the top wall 39 and a cover 71 hinged to the top wall 39 and lockable in desired inclined position by any conventional adjusting and locking mechanism 73. It is thus appreciated that the size of the opening 69 is much greater than in conventional snow blowers thereby appreciably reducing clogging tendency of the belts 9, 11.

Scraper members shaped as shown in FIGS. 7 and 8 are interesting in that they allow the snowblower to be used with a standard snow outlet of tubular shape, instead of using an elongated outlet 69 as shown in FIG. 1. Indeed, it has been found that scraper members as shown in FIGS. 7 and 8 causes the snow to be "centered" during its upwards movement into the channel 17, and then projected outwardly through a restricted surface area.

What is claimed is:

1. A snowblower comprising:

a casing having an upstanding rear wall and a generally rectangular opening facing said rear wall;

an endless belt and means for mounting said belt vertically on and within said casing between said rear wall and said opening, said belt defining a forward strand facing said opening and a rearward strand facing said rear wall at a distance therefrom, said rearward strand and rear wall defining therebetween a vertical snow-ejection passage of constant cross-section;

snow scraper members fixed to and projecting away from said belt transversely thereof, said snow scraper members having a projecting length, away from the belt, essentially equal to said distance between said rearward strand and said rear wall; and means for driving said belt in endless travel with said forward strand moving downwardly at such a speed that the scraper members travelling downwardly with the forward strand have enough power to dig into the snow and drive it downwardly and rearwardly while the scraper members travelling upwardly with the rearward strand have enough power to move the dug snow upwardly through the ejection passage and blow it away from the casing through a top opening provided above said ejection passage.

2. A snowblower as claimed in claim 1, wherein said scraper members are straight flat bars extending transversely of said belt, said bars being evenly spaced from one another.

3. A snowblower as claimed in claim 2, wherein said straight bars are flanges of angular members, each angular member having a further flange and means securing said further flange to said belt.

4. A snowblower as claimed in claim 1, wherein said belt is made of rubbery material.

5. A snowblower as claimed in claim 1, wherein said belt is formed with apertures for ejection of snow having filtered into the space between said strands.

6. A snowblower according to claim 1, wherein said means for mounting said belt on said casing comprises:

at least one upper roller and an upper shaft on which said upper roller is mounted for rotation and means on said casing and at the ends of said upper shaft for adjusting the tightness of said belt;

at least one lower roller and a lower shaft over which said lower roller is fixed; and power means connected to said lower shaft for driving said lower shaft and roller into rotation and said belt into endless travel.

7. A snowblower as claimed in claim 1, wherein each snow scraper member comprises a series of arcuately aligned juxtaposed short scraper parts.

8. A snowblower as claimed in claim 1, wherein each snow scraper member comprises two downwardly inclined end scraper parts and a central horizontal scraper part between said end parts.

9. A snowblower as claimed in claim 1, wherein said casing has a top wall provided with said top opening and said snowblower further comprises snow outlet means of tubular shape aligned with said top opening for the discharge of snow blown by said travelling belt and scraper members.

* * * * *